US007316398B1

(12) United States Patent
Pham

(10) Patent No.: US 7,316,398 B1
(45) Date of Patent: Jan. 8, 2008

(54) FORTY-TWO CARD GAME AND METHOD OF PLAYING THE SAME

(76) Inventor: Bryan E. Pham, 203 Crown Ct., Egg Harbor Township, NJ (US) 08234

( * ) Notice: Subject to any disclaimer, the term of this patent is extended or adjusted under 35 U.S.C. 154(b) by 101 days.

(21) Appl. No.: 11/374,253

(22) Filed: Mar. 13, 2006

(51) Int. Cl.
*A63F 1/00* (2006.01)

(52) U.S. Cl. ..... 273/292; 273/274

(58) Field of Classification Search ..... 273/292, 273/274, 309; 463/12, 13
See application file for complete search history.

(56) References Cited

U.S. PATENT DOCUMENTS

| | | | | |
|---|---|---|---|---|
| 5,265,882 | A | 11/1993 | Malek | |
| 5,529,309 | A * | 6/1996 | Bartlett | 273/292 |
| 6,237,917 | B1 * | 5/2001 | Timpano | 273/292 |
| 6,299,171 | B1 * | 10/2001 | Mollo et al. | 273/292 |
| 6,446,973 | B1 * | 9/2002 | Pham | 273/306 |
| 6,588,758 | B1 | 7/2003 | Lee | |
| 6,837,494 | B2 | 1/2005 | Lee | |
| 2003/0013510 | A1 | 1/2003 | Vuong et al. | |
| 2004/0217547 | A1 | 11/2004 | Lau et al. | |
| 2005/0029746 | A1 * | 2/2005 | O'Toole | 273/292 |

OTHER PUBLICATIONS

"Bacc-Jack", Casino Gaming Concepts, Inc., 1995.*

* cited by examiner

*Primary Examiner*—Benjamin Layno
(74) *Attorney, Agent, or Firm*—Norman E. Lehrer

(57) ABSTRACT

The card game of the present invention utilizes a deck of 42 cards which may resemble a standard deck of playing cards. The deck includes three Pictures (preferably tigers and/or dragons) and three each of Aces through Kings. The game begins with a dealer dealing two cards face up to each player and dealing one card up and one card down to himself or herself. Each player is then given the option to drawn an additional card if he or she is dealt anything other than a natural nine. The dealer then draws an additional card with a point count of five or less but must stay with a point count of six to nine. When all of the dealing and card drawing is over, each player compares his or her hand to the dealer's hand. The winner is determined based on a combination of poker and Baccarat rules.

1 Claim, 2 Drawing Sheets

FORTY-TWO CARD GAME AND METHOD OF PLAYING THE SAME

BACKGROUND OF THE INVENTION

The present invention is directed toward a new card game which, in some aspects, is similar to the game of poker and, in other aspects is similar to the game of Baccarat. The invention relates to a new deck of cards and to a new method of play utilizing the novel cards, the intent of which is to make the game more interesting and to increase revenues for casinos.

Poker is a well known card game and has many variations. The basic game of poker involves dealing five cards to each player. Each player may then discard up to three cards and be dealt new cards in order to improve his or her hand. An initial wager is placed by all of the players. Additional bets may be placed throughout the course of the game. The winner is the player holding the highest hand based upon a predetermined set of rules. Variations of these basic rules are also well known, such as, Draw poker, Stud poker, and Pai Gow poker.

Poker is often played in gaming establishments as well as in private parties. It has also been implemented as a slot machine game. However, despite the numerous variations, longtime players of the game may seek an even more exciting game that still involves poker rules.

Baccarat is another popular table game played in casinos or gaming establishments. Baccarat also uses a standard deck of 52 playing cards and is usually dealt from a shoe having multiple decks that have been shuffled together prior to the beginning of play.

The object of the game of Baccarat is for the bettor to successfully wager on whether the bank's hand or the player's hand is going to win. The bettor receives even money for his wager if he selects the winning hand and loses his wager if he selects the losing hand. In a conventional Baccarat game, each bettor first makes a wager on whether the bank's hand or the player's hand will win. After all wagers are made, two cards are dealt from the shoe to the bank position and two cards are dealt from the shoe to the player position on the table layout. The cards are turned face up and the value of the bank hand the player hand is determined, modulo ten. In determining values, aces count as one; kings, queens, jacks and tens count as zero and the other cards count as their respective face value. The suits have no meaning in Baccarat.

The highest hand value in Baccarat is nine. All hand values range from a low of zero to a high of nine. If when the cards are added together, the total of the hand exceeds nine, then the hand value is determined modulo ten. For example, a seven and an eight total fifteen, but the hand value is five. An ace and a nine total ten, but the hand value is zero. Under certain situations in the play of the game, a third card will be dealt. The value of this third card is added to the total of the first two cards and a new hand value is established. Again, if the new hand total exceeds nine, the hand value is determined by subtracting ten from the total of the hand.

While Baccarat is relatively simple to play because of the relative ease in determining the rankings of the hands, it also can become monotonous as there are essentially no decisions to be made by the player. The cards are automatically dealt to each player according to the rules and the winner is determined automatically according to the established rules. The player essentially watches.

There is, therefore, a need for a casino card game that combines the intricacies and mental challenge of poker with the ease of Baccarat. Such a game would encourage the players to play and to play longer which would obviously result in increased revenues for the casino or other gaming establishment.

SUMMARY OF THE INVENTION

The present invention is designed to overcome the deficiencies of the prior art described above. It is an object of the present invention to provide a new card game that is mentally challenging but is also easy to play.

It is another object of the present invention to provide a new card game that encourages players to play and to play longer, thereby increasing a gaming establishment's revenue.

In accordance with the illustrative embodiments demonstrating features and advantages of the present invention, there is provided a method of playing a game of cards using a deck of forty-two cards including three Pictures (preferably tigers and/or dragons) and three each of Aces through Kings. To begin, a dealer deals two cards face up to each player and deals one card up and card down to him or herself. Each player is given the option to drawn an additional card if he or she is dealt anything other than a nine. The dealer then draws an additional card with a five or less but stays with a point count of six to nine. Players compare their hands to the dealer's hand. The winner is determined based on a combination of poker and Baccarat rules.

Other objects, features, and advantages of the invention will be readily apparent from the following detailed description of a preferred embodiment.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 2:
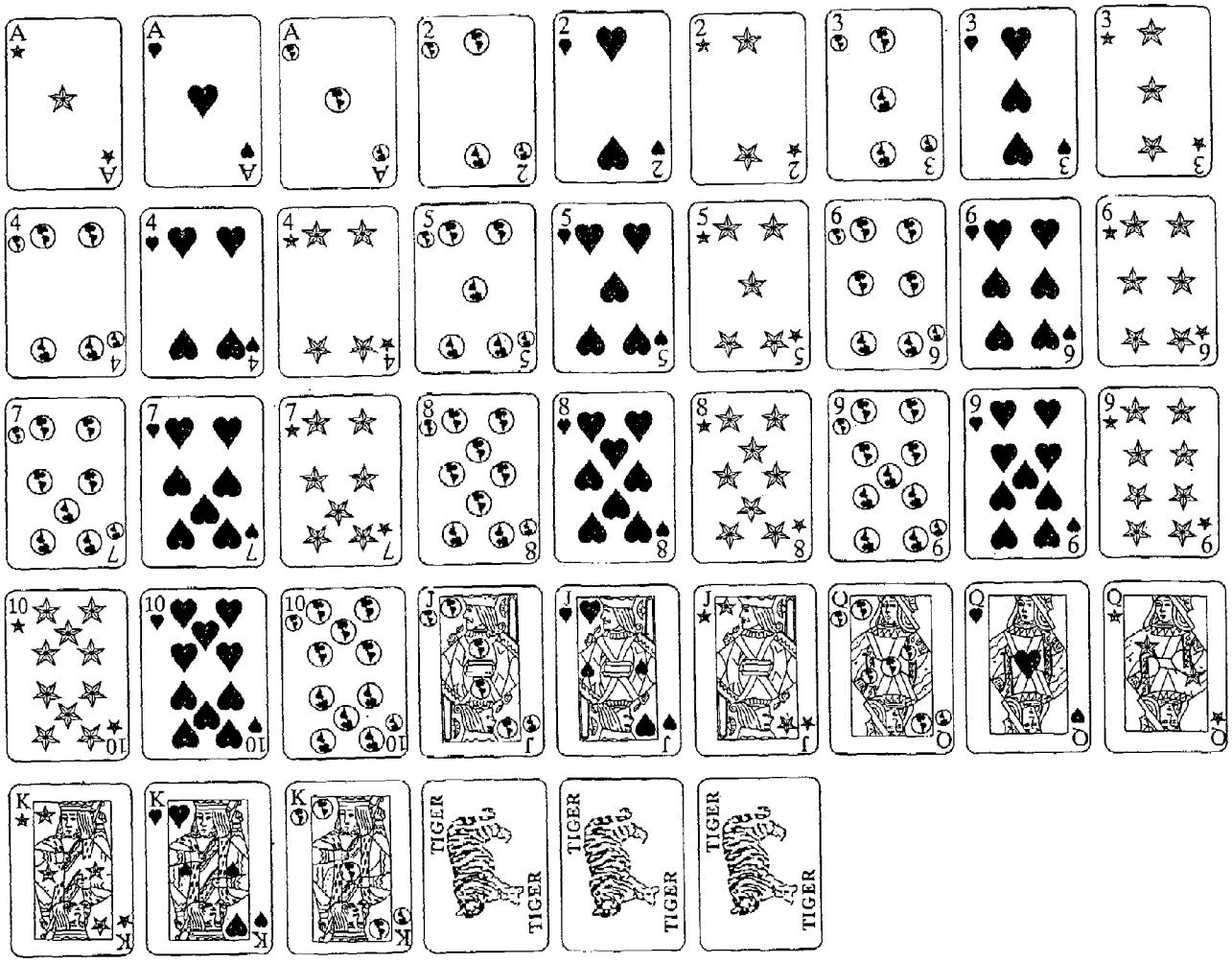
FIG. 2 is a plan view of the playing cards used to play the game of the present invention.

As shown in FIG. 2, the present game is played with a deck of forty two cards and may or may not have different suits. The deck is comprised of three Pictures (preferably tigers and/or dragons) and three each of Aces through Kings. In determining values, aces count as one; Pictures, Kings, Queens, Jacks and tens count as zero and the other cards count as their respective face value. If, when the cards are added together, the total of the hand exceeds nine, then the hand value is determined modulo ten.

Figure 1:
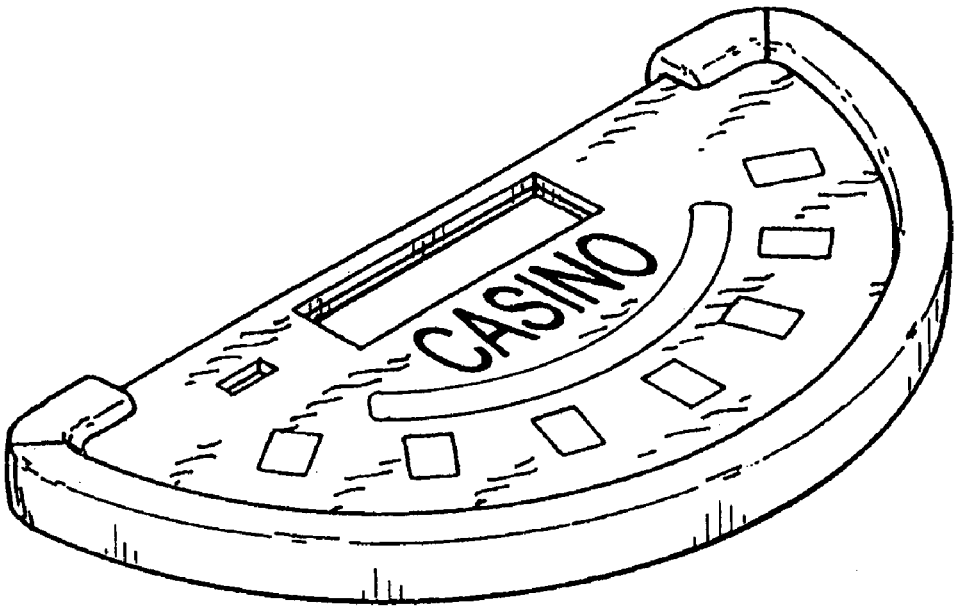
FIG. 1 is a plan view of a gaming table top upon which the game of the present invention can be played.

The game is preferably played at a gaming table such as shown in FIG. 1 which may closely resemble a blackjack or baccarat table. The table would have six or more player positions and a dealer's position. This, however, is by way of example only as other table arrangements are also possible.

After the cards are shuffled and a wager is placed by each of the players, play begins with a dealer dealing two cards face up to each player and dealing one card up and one card down to him or herself. If the first two cards to a player equals nine, this is considered a natural and the player automatically wins unless the dealer also has a natural "9" in which case, it is considered a push. If, however, the player's first two cards do not equal nine, the player is then given the option to drawn an additional card. If the player's first two cards equals zero, the player must draw a third card. If the player has a point count of zero after drawing a third card, he or she loses. This includes combinations of different "10" point cards such as tens, face cards or Pictures. Three of a kind, such as three tens, three face cards or three Pictures, however, is treated differently, as pointed out below.

The dealer, on the other hand, has no option. He or she must draw with a point count of five or less and must stand with a point count of six to nine.

After the dealing and drawing is completed, the players compare their hands to the dealer's hand and the winner is determined based on a combination of poker and Baccarat rules. The two card rule i.e. natural nine is applied first. Thereafter, poker rules apply. Using poker rules, three of a kind is required to participate. As is conventional, three Pictures beat three Aces, three Aces beat three Kings, three Kings beat three Queens, and so forth. The lowest possible winning poker hand is, therefore, three deuces.

If a player does not have a natural nine or three of a kind, Baccarat rules come into play, so that the next highest hand is the hand closest to nine. As pointed out above, in determining values when applying Baccarat rules, aces count as one; Pictures, Kings, Queens, Jacks and tens count as zero and the other cards count as their respective face value. If when the cards are added together, the total of the hand exceeds nine, then the hand value is determined modulo ten. In other words, ten is subtracted from the total of the hand. As between the player and the dealer, the hand closest to nine wins.

The present invention may be embodied in other specific forms without departing from the spirit or essential attributes thereof and accordingly, reference should be made to the appended claims rather than to the foregoing specification as indicating the scope of the invention.

I claim:

1. A method of playing a game of cards between a dealer and one or more players using a deck of forty-two cards including three Pictures and three each of Aces Two through Tens, Jacks, Queens and Kings comprising the steps of:

assigning point values to the cards wherein Aces count as one; Pictures, Kings, Queens, Jacks and Tens count as zero and Twos through Nines count as their respective face value;

a dealer dealing a hand of two cards face up to each player and dealing a hand of two cards one card face up and one card face down to him or herself;

determining a total point count for each of the players' hands of two cards and the dealer's hand of two cards by adding the point values of the two cards in each hand, if the total of the added points values of any of the hands exceeds nine, the total point count is determined by subtracting ten from the total of the added point values;

each player being given the option to draw an additional card to add to their hand of two cards only if he or she is dealt a hand of two cards having a total point count of anything other than a nine;

said dealer drawing an additional card if the dealer's hand of two cards has a total point count of five or less but said dealer staying with the hand of two cards if the dealer's hand of two cards has a total point count of six to nine; and said players comparing their hands to the dealer's hand and the winner being determined based on a combination of poker and Baccarat rules.

* * * * *